US005585807A

United States Patent [19]

Takei

[11] Patent Number: 5,585,807

[45] Date of Patent: Dec. 17, 1996

[54] SMALL ANTENNA FOR PORTABLE RADIO PHONE

[75] Inventor: Ken Takei, Hachioji, Japan

[73] Assignee: Hitachi, Ltd., Tokyo, Japan

[21] Appl. No.: 362,876

[22] Filed: Dec. 23, 1994

[30] Foreign Application Priority Data

Dec. 27, 1993 [JP] Japan ..... 5-330522

[51] Int. Cl.[6] ..... H01Q 1/24

[52] U.S. Cl. ..... 343/702; 343/700 MS; 343/837

[58] Field of Search ..... 343/702, 700 MS, 343/846, 833, 834, 837, 829, 830, 848; 455/89, 90; H01Q 1/24

[56] References Cited

U.S. PATENT DOCUMENTS 4,809,008 2/1989 Gunton ..... 343/700 MS
4,835,540 5/1989 Haruyama et al. ..... 343/700 MS
4,907,006 3/1990 Nishikawa et al. ..... 343/700 MS
5,148,181 9/1992 Yokoyama et al. ..... 343/702

*Primary Examiner*—Donald T. Hajec
*Assistant Examiner*—Hoanganh Le
*Attorney, Agent, or Firm*—Antonelli, Terry, Stout & Kraus

[57] ABSTRACT

It is possible to realize an antenna realizing excellent matching with impedance of an RF part without including a resonant part that accumulates large reactive power in a small volume on a finite ground formed of a body of a portable radio phone by feeding a linear conductor presenting a step structure having a part parallel to the finite ground as an antenna and juxtaposing a linear conductor having a part parallel to another one or plurality of finite grounds in close vicinity to a linear conductor having a step structure on a finite ground in contact or non-contact therewith electrically. Accordingly, it is made possible to provide a small antenna or a built-in antenna applied to a small portable radio phone.

48 Claims, 11 Drawing Sheets

SMALL ANTENNA FOR PORTABLE RADIO PHONE

BACKGROUND OF THE INVENTION

1. Field of the Invention

The present invention relates to an antenna applied to a small portable terminal in which dimensions of a terminal such as a portable mobile terminal are under ¼ of a wavelength.

2. Description of the Related Art

In a small antenna or a built-in antenna applied to a small terminal having a small volume such as a portable mobile terminal, impedance matching with a radio frequency becomes more difficult as the antenna becomes smaller in size and becomes to be formed in a built-in structure, thus requiring various measures. In a related art, miniaturization is aimed at with a linear-plate inverse-F antenna that is excellent in point of miniaturization and a built-in structure as a basis. The details thereof have been discussed in JP-A-2-22563 and JP-A-2-21164 for instance.

In all of the related art, matching is obtained with inverse-F antennas presenting capacitive characteristics essentially by using a matching pin presenting inductive characteristics provided in the vicinity of an exciting point.

A perspective view and a side view of a typical inverse-F antenna are shown in FIG. 22 and FIG. 23. The inverse-F antenna can be regarded as a distributed constant circuit formed of a capacitive component $C_2$ formed between a horizontal portion of a laminar antenna 27 and a finite ground, a capacitive component $C_1$ formed between a feed line 2*a* and a vertical portion (a matching pin) of the laminar antenna 27 and an inductance L proportional to a height l of the vertical portion (the matching pin) of the laminar antenna 27 when viewed from an exciting point 4. Since the capacitive component $C_2$ is increased as the dimensions of the antenna get smaller in a height direction in the case of miniaturization of an antenna, it is required to increase the component of inductance L in order to deny the increase of $C_2$. However, the height l of the vertical portion (the matching pin) of the laminar antenna 27 is also decreased as the antenna dimensions get smaller in the height direction and the value of the inductance L gets smaller. Therefore, a method of increasing the inductance L equivalently by using an inductive electromagnetic field is adopted in the related art. In general, an electromagnetic field includes components that attenuate in proportion to the first power, the second power and the third power of the distance, but the component that attenuates in proportion to the second power of the distance is the inductive electromagnetic field. Since the electromagnetic field that attenuates in proportion to the second power of the distance is used in order to increase the inductance L, it becomes required to make the distance d between the feed line 2*a* and the vertical portion (the matching pin) of the laminar antenna 27 smaller. When the distance d is made too small, however, the influence by an electromagnetic wave that attenuates in proportion to the third power of the distance is also exerted at the same time. Since the electromagnetic wave that attenuates in proportion to the third power of the distance increases an ohmic loss of a conductor forming an antenna, the loss of a feed line or a matching pin that is a conductor is increased, thus lowering antenna efficiency. Therefore, there has been a subject of solving such a problem.

SUMMARY OF THE INVENTION

The above-mentioned subject is solved by feeding a linear conductor presenting a step structure having a part running parallel to a finite ground as an antenna, and juxtaposing one or plural other linear conductors each having a part running parallel to said finite grounds in close vicinity to the linear conductor having the step structure on the finite ground formed of a body of a portable radio phone in contact or non-contact electrically therewith.

The part parallel to the finite ground of the linear conductor presenting the step structure is an antenna and also forms a type of condenser between the part and the finite ground, which causes the capacitive nature of the inverse-F antenna. FIG. 24 shows a side view of an antenna that becomes equivalent to FIG. 23 (a side view of the inverse-F antenna) when an image theorem is applied. FIG. 24 is also conceivable to be a structure that parallel lines are excited with the feed line 2*a*. The impedance of the parallel lines is determined by a distance 2l between the parallel lines. In the case of a small antenna having a volume of approximately several cc and a frequency of about 1 GHz or so, the impedance of the parallel lines becomes several 100Ω. Since the impedance of a normal exciting source is 50Ω, it is possible to obtain matching between two different impedance by inserting a line having intermediate impedance between the exciting source and the parallel lines. Thus, since the impedance of the parallel lines is in proportion to the distance between respective parallel lines, it is possible to achieve impedance matching when parallel lines having the distance between the parallel lines 2l ' shorter than 2l (l'<l) are provided as shown in FIG. 1. Further, since it is not required to use an inductive electromagnetic field in this case, entirely similar operation is also realized with such a structure as shown in FIG. 2. When the structure shown in FIG. 2 is returned to an original state by applying the image theorem again, a step structure such as shown in FIG. 3 and FIG. 4 is obtained. Thus, by making a step conductor in which a linear conductor stretches perpendicularly to a finite ground from one point on the finite ground such as a body of a portable radio phone, then the linear conductor stretches in parallel to the finite ground, then the linear conductor stretches again perpendicularly to the finite ground, and then the linear conductor stretches again in parallel to the finite ground operate as an antenna, it is possible to realize a small antenna that realizes excellent matching with RF impedance without increasing an ohmic loss by the electromagnetic field that attenuates in proportion to the third power caused by using an inductive electromagnetic field.

Furthermore, when the same structure is juxtaposed with the step structure described above as shown in FIG. 6, input impedance is lowered, and the matching of an antenna having high impedance originally with an exciting source having low impedance becomes easier.

Further, when a parallel line structure and an inverse-L structure are juxtaposed with each other as shown in FIG. 7 and FIG. 8, it is also possible to lower the input impedance, and to obtain matching easily because of similar reasons.

The foregoing and other objects, advantages, manner of operation and novel features of the present invention will be understood from the following detailed description when read in connection with the accompanying drawings.

DESCRIPTION OF THE PREFERRED EMBODIMENTS

Figure 1:
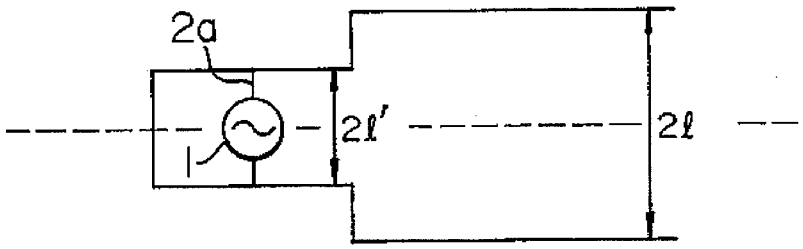
FIG. 1 is a side view of an antenna obtained in a coil in which parallel lines having intermediate impedance are inserted into an antenna shown in FIG. 24.
Figure 2:
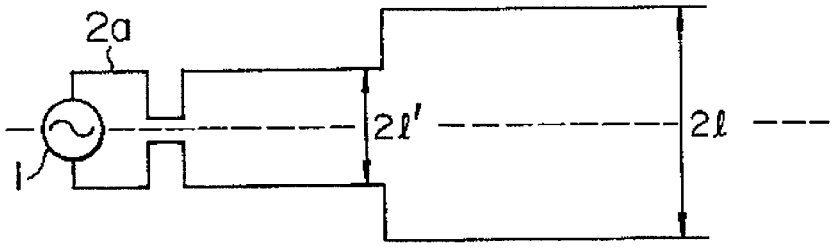
FIG. 2 is a side view showing an embodiment of a small antenna for a portable radio phone according to the present invention.
Figure 3:
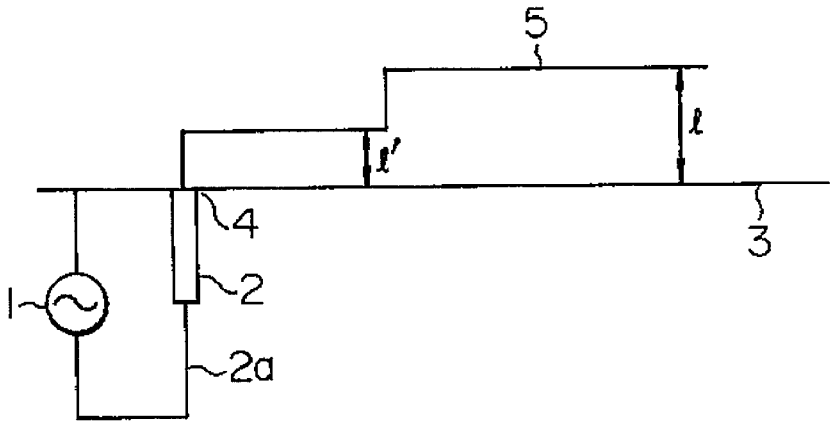
FIG. 3 is a side view showing an embodiment of a small antenna for a portable radio phone according to the present invention.
Figure 4:
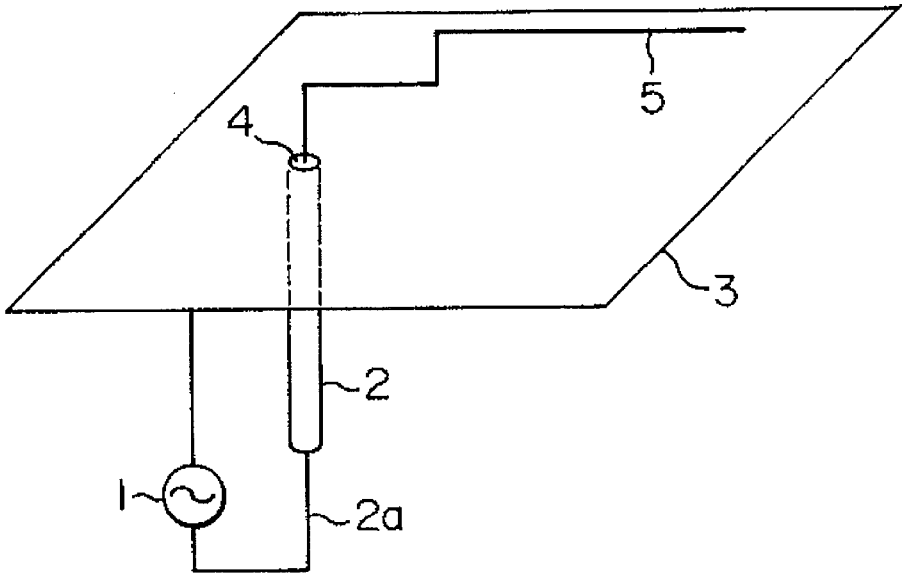
FIG. 4 is a perspective view showing an embodiment of a small antenna for a portable radio phone according to the present invention.

An embodiment of the present invention will be described hereinafter with reference to FIG. 4. FIG. 4 is a perspective view showing an embodiment of a small antenna for a portable radio phone according to the present invention. A step conductor 5 having two steps is connected with an exciting point 4 on a body of radio phone or a finite ground 3 corresponding to a part of a circuit substrate. The step conductor 5 has a structure of stretching first perpendicularly to the finite ground 3 from the connecting point, then stretching in parallel with the finite ground 3, then stretching again perpendicularly to the finite ground 3, and further stretching in parallel with the finite ground 3. An unbalanced line 2 connects an exciting source 1 and the exciting point 4 with each other through an inner conductor (a feed line 2*a*) on the back of the finite ground 3 or on the face where the step conductor 5 does not exist while the unbalanced line 2 connecting the outer conductor thereof electrically to the finite ground 3.

The part of the step conductor stretching in parallel with the finite ground 3 corresponding to the second step when viewed from the exciting point 4 operates as an antenna, and also operates as a line having high impedance against the finite ground 3 at the same time. The impedance as a line of the part of the step conductor stretching in parallel with the finite ground 3 corresponding to the first step when viewed from the exciting point 4 that is connected electrically between the part of the second step and the exciting point 4 having low impedance of 50Ω has an intermediate value between the impedance of the exciting point 4 and the impedance of the part of the step conductor stretching in parallel with the finite ground 3 corresponding to the second step when viewed from the exciting point 4. As a result, the antenna of the present embodiment is able to realize an excellent matching state with the radio frequency at the exciting point 4.

Further, since a part where two linear conductors are placed in parallel with each other in close vicinity is not included in the structure in the present embodiment, it is not subject to the influence of the electromagnetic wave attenuating in proportion to the third power of the distance, but also has an effect of solving the problem of deterioration of antenna efficiency.

Figure 5:
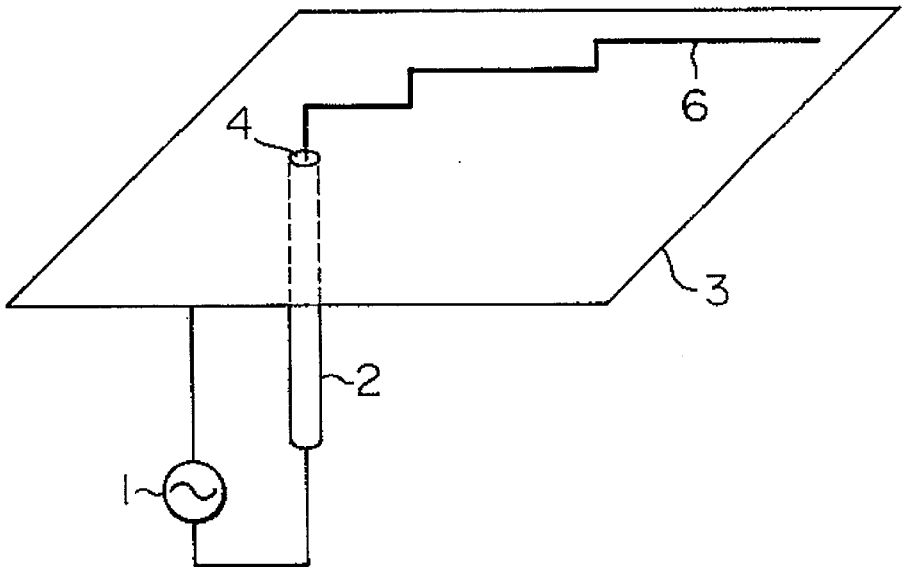
FIG. 5 is a perspective view showing an embodiment of a small antenna for a portable radio phone according to the present invention.
Figure 6:
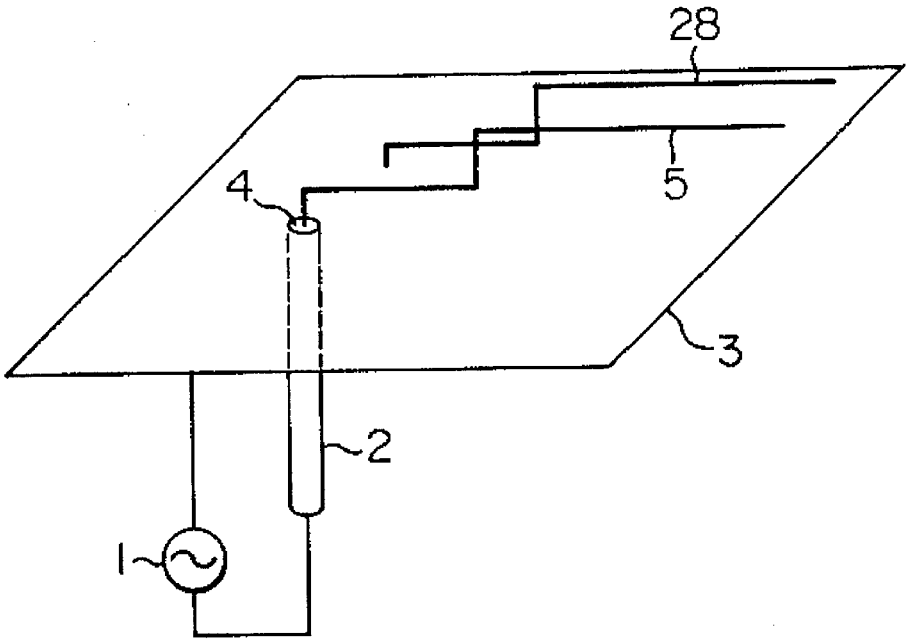
FIG. 6 is a perspective view showing an embodiment in which a step structure of a small antenna for a portable radio phone according to the present invention is juxtaposed.

FIG. 5 is a perspective view showing an embodiment of a small antenna for a portable radio phone according to the present invention. What differs from FIG. 4 is the fact that a step conductor 6 is formed into multisteps until the third step is formed. The parts in respective steps stretching in parallel with the finite ground 3 form a structure that the impedance is increased in consecutive order from the exciting point 4 since the values of characteristic impedance are in proportion to the distance from the finite ground 3 when these parts are considered as lines. As a result, a sudden change of the impedance of respective parts in the antenna structure is restrained as compared with the structure shown in FIG. 4. Thus, there is an effect of controlling a sudden change of the impedance with respect to the frequency at the part of the exciting point.

Figure 7:
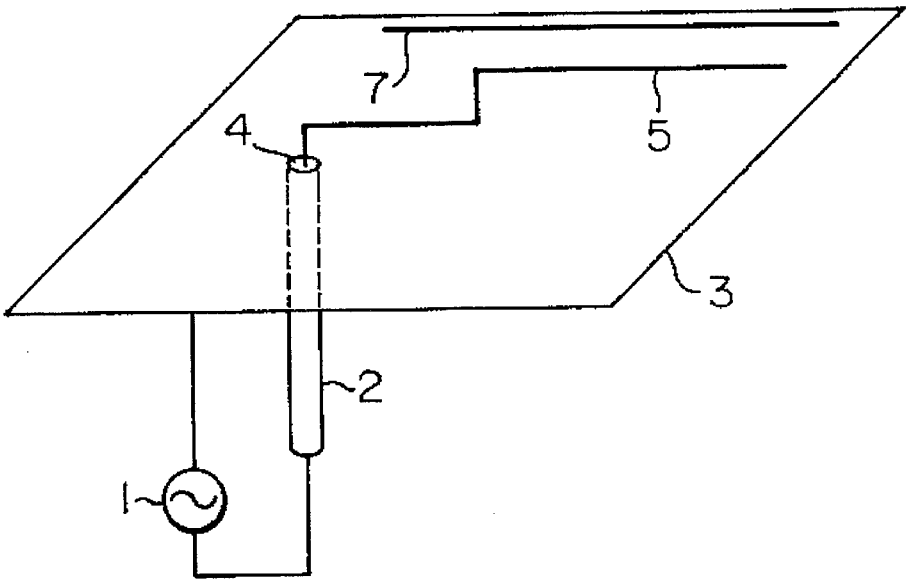
FIG. 7 is a perspective view showing an embodiment of a small antenna for a portable radio phone according to the present invention.

FIG. 7 is a perspective view showing an embodiment of a small antenna for a portable radio phone according to the present invention. What differs from FIG. 4 is the fact that there is provided, separately from the step conductor 5, a second conductor 7 stretching in parallel with the finite ground 3 in close vicinity thereto in parallel with a part parallel to the finite ground 3 of the step conductor without coming into contact therewith electrically. The energy supplied to the antenna from the exciting point 4 moves on the conductor as an induced current until the energy is released into a free space. Since the step conductor 5 and the second conductor 7 are installed in close vicinity to each other, however, the energy can move in a form of a conductive current between both conductors. As a result, the length where the energy moves from the exciting point 4 into the free space is diversified and the change of the impedance with respect to the frequency of the part of the exciting point is restrained, thus resulting in an effect of increasing a frequency band where the conditions of excellent impedance matching are satisfied between the radio frequency and the antenna.

Figure 8:
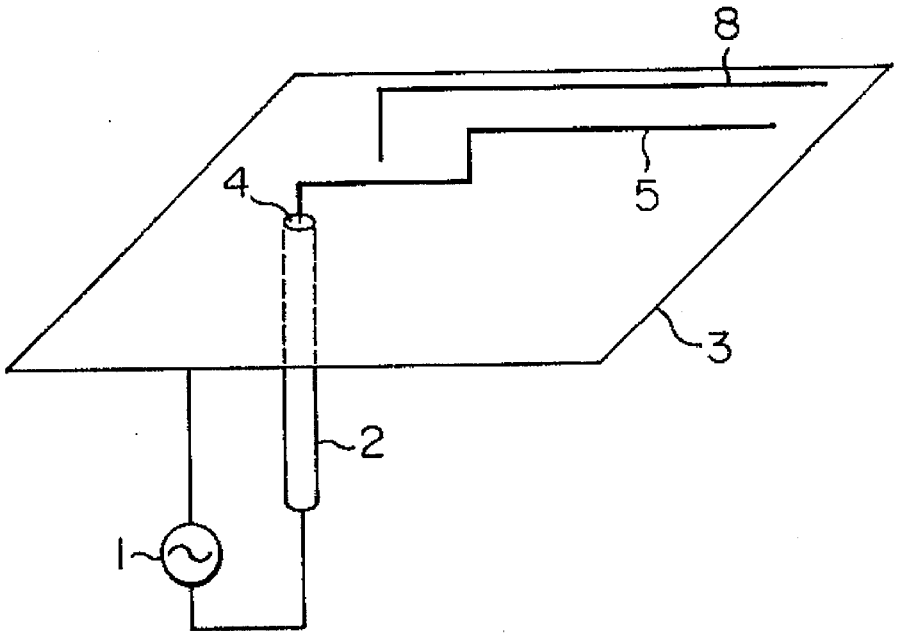
FIG. 8 is a perspective view showing an embodiment of a small antenna for a portable radio phone according to the present invention.

FIG. 8 is a perspective view showing an embodiment of a small antenna for a portable radio phone according to the present invention. What differs from FIG. 7 is the fact that, separately from the step conductor 5, one end of the second conductor 7 stretching in parallel to the finite ground 3 in close vicinity to the part parallel to the finite ground 3 of the step conductor 5 in parallel thereto and without coming into contact electrically therewith is replaced with a third conductor 8 having a form connected electrically with a conductor perpendicular to the finite ground 3. Since the third conductor 8 is in a state that one end is short-circuited electrically and another end is opened electrically, resonance conditions required when the current energy is converted into the electric wave energy can be realized with a shorter wavelength of approximately ¼ wavelength as compared with the case of the second conductor 7 in a state that both ends thereof are open. Thus, an effect of reducing the volume of the antenna is produced.

Figure 9:
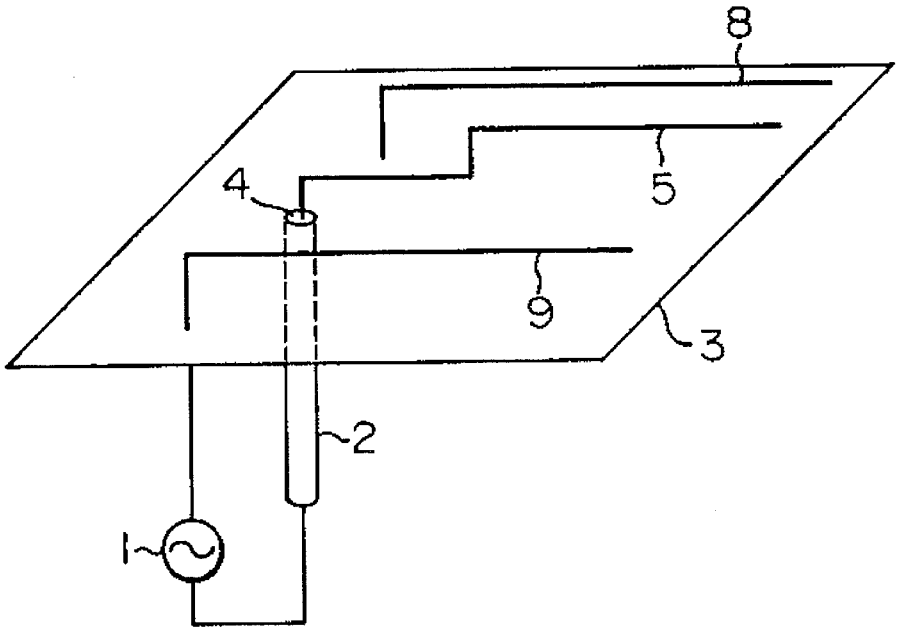
FIG. 9 is a perspective view showing an embodiment of a small antenna for a portable radio phone according to the present invention.

FIG. 9 is a perspective view showing an embodiment of a small antenna for a portable radio phone according to the present invention. What differs from FIG. 8 is the fact that there is provided, separately from the step conductor 5, another third conductor 9 stretching in parallel to the finite ground 3 in close vicinity to the third conductor 8 in parallel thereto and without coming into contact electrically therewith in addition to the third conductor 8 stretching in parallel with the finite ground 3 in close vicinity to the part parallel to the finite ground 3 of the step conductor 5 in parallel thereto and without coming into contact electrically therewith. As compared with the case of FIG. 8, the length where the energy passes into the free space from the exciting point 4 is diversified further and the change of impedance with respect to the frequency at the part of the exciting point is restrained, thus resulting in an effect of further increasing the frequency band where the conditions of excellent impedance matching are satisfied between the radio frequency and the antenna.

Figure 10:
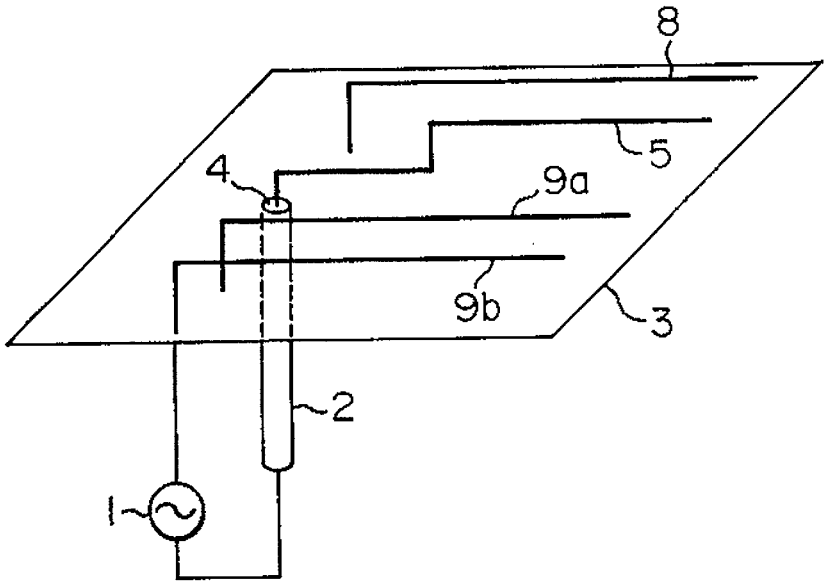
FIG. 10 is a perspective view showing an embodiment of a small antenna for a portable radio phone according to the present invention.
Figure 11:
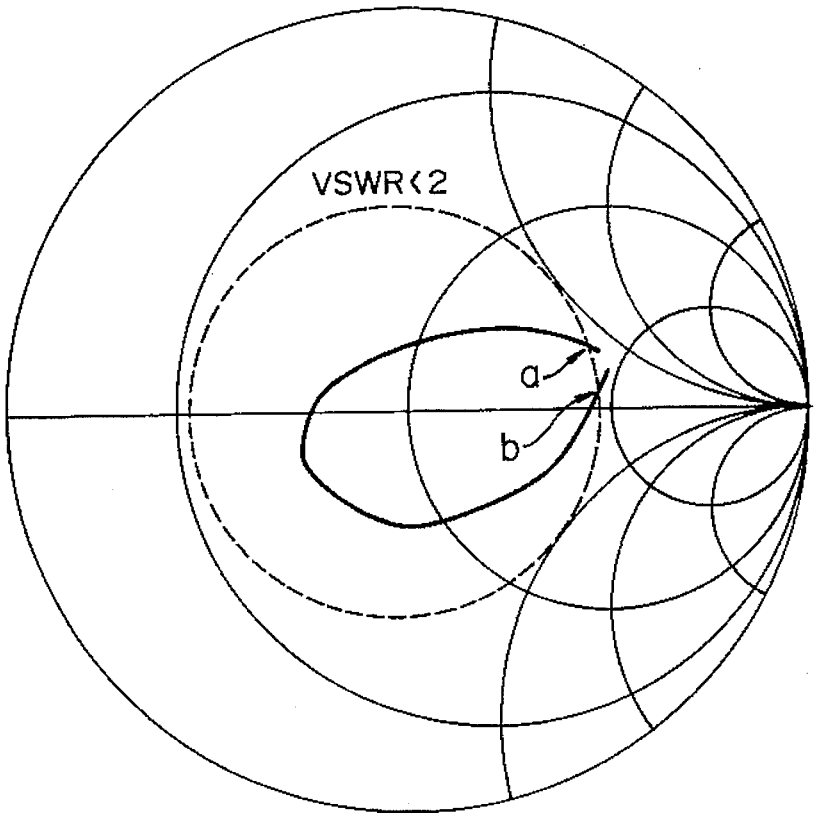
FIG. 11 is a Smith chart showing a matching state with a radio frequency in an embodiment of the small antenna for a portable radio phone shown in FIG. 10.

FIG. 10 is a perspective view showing an embodiment of a small antenna for a portable radio phone according to the present invention, and FIG. 11 is a Smith diagram showing a frequency characteristic of input impedance thereof.

What differs from FIG. 9 is the fact that a plurality of third conductors 9 are provided. As compared with the case of FIG. 9, the length where the energy moves into the free space from the exciting point 4 is further diversified, and the frequency band where the conditions of excellent impedance matching are satisfied between the radio frequency and the antenna is increased by a large margin. As shown in FIG. 11, an excellent matching state of VSWR<2 has been realized in the frequency from a point a over to a point b shown in the figure, and matching bands of 2.5% are realized at the volumes at 0.18 wavelength, 0.025 wavelength and 0.02 wavelength.

Figure 12:
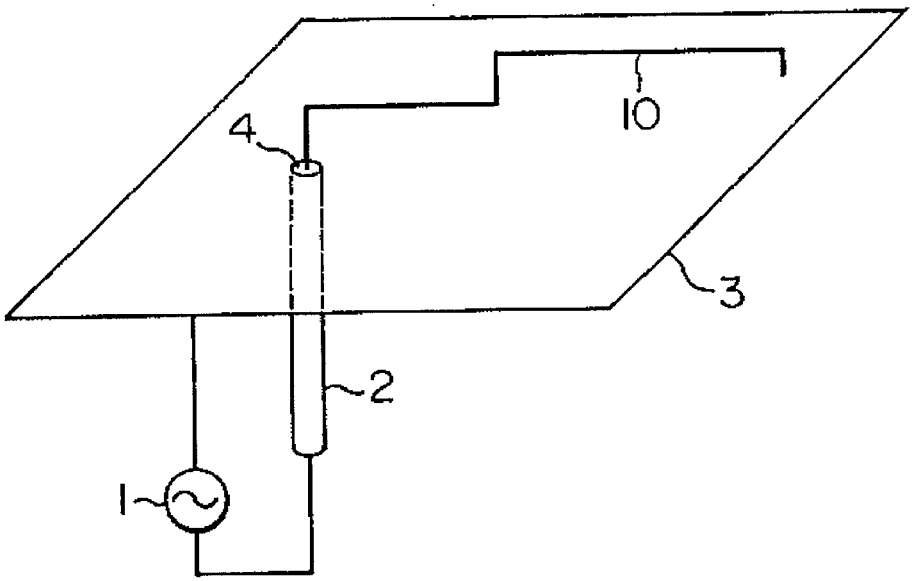
FIG. 12 is a perspective view showing an embodiment of a small antenna for a portable radio phone according to the present invention.

FIG. 12 is a perspective view showing an embodiment of a small antenna for a portable radio phone according to the present invention. What differs from FIG. 4 is the fact that the step conductor 5 is replaced with a conductor 10 presenting a configuration that a conductor perpendicular to the step conductor 5 is connected without coming into contact electrically with the finite ground 3 at one end different from the exciting point 4 of the step conductor 5. As compared with the case of FIG. 4, since it is possible to finely adjust the impedance at the part of the exciting point by adjusting the length of the conductor perpendicular to the step conductor 5, an effect that dispersion of performance when the present embodiment is applied to products can be compensated easily is produced.

Figure 13:
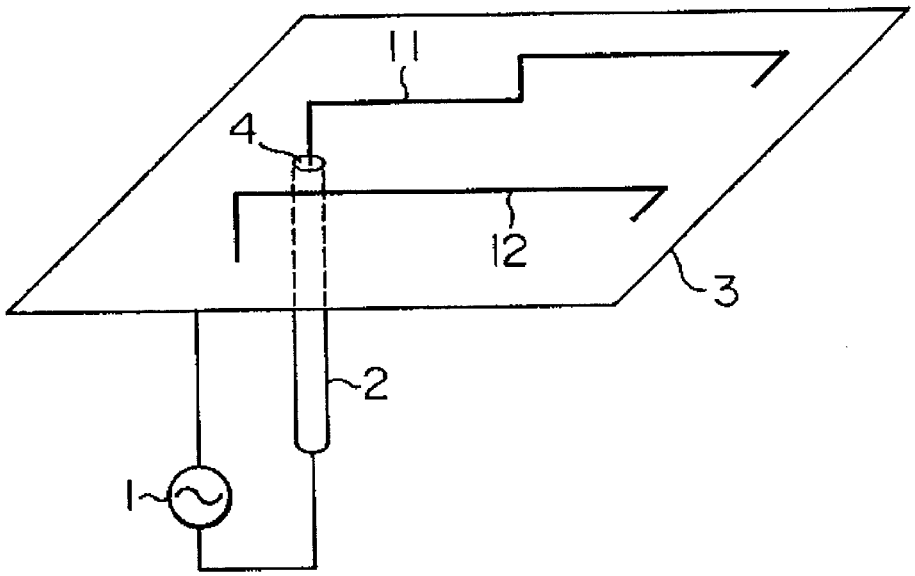
FIG. 13 is a perspective view showing an embodiment of a small antenna for a portable radio phone according to the present invention.

FIG. 13 is a perspective view showing an embodiment of a small antenna for a portable radio phone according to the present invention. What differs from FIG. 8 is the fact that the step conductor 5 is replaced with a conductor 11 presenting a configuration that a conductor perpendicular to the step conductor 5 is connected without coming into contact electrically with the finite ground 3 at one end different from the exciting point 4 of the step conductor 5, and the third conductor 8 is replaced with a conductor 12 presenting a configuration that a conductor perpendicular to the third conductor 8 is connected without coming into contact electrically with the finite ground 3 at one end of the third conductor 8 that is not grounded to the finite ground 3. As compared with the case of FIG. 8, since it is possible to finely adjust the impedance at the part of the exciting point by adjusting the length of the conductor perpendicular to the step conductor 5 and the length of the conductor perpendicular to the third conductor 8, an effect that dispersion of performance when the present embodiment is applied to products can be compensated easily is produced.

Figure 14:
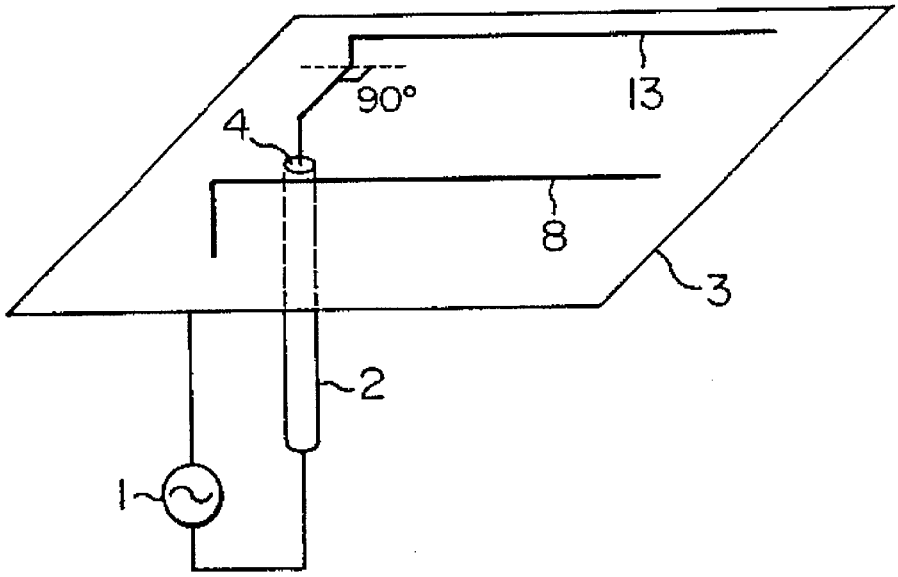
FIG. 14 is a perspective view showing an embodiment of a small antenna for a portable radio phone according to the present invention.

FIG. 14 is a perspective view showing an embodiment of a small antenna for a portable radio phone according to the present invention. What differs from FIG. 8 is the fact that the step conductor 5 is replaced with a conductor 13 presenting a configuration that angles formed by respective parts parallel to the finite ground 3 of the step conductor 5 are not 180° and the central axes of the linear conductors forming the step conductor 5 do not exist in the same plane, but intersect one another at 90 degrees and exist in a semi-infinite plane including an edge at the end portion thereof in common. As compared with FIG. 8, there is an effect of increasing the degree of freedom of arrangement in a body when the antenna of the present embodiment is built in a body since the length in a longitudinal direction of the antenna structure can be reduced in the present embodiment.

Figure 15:
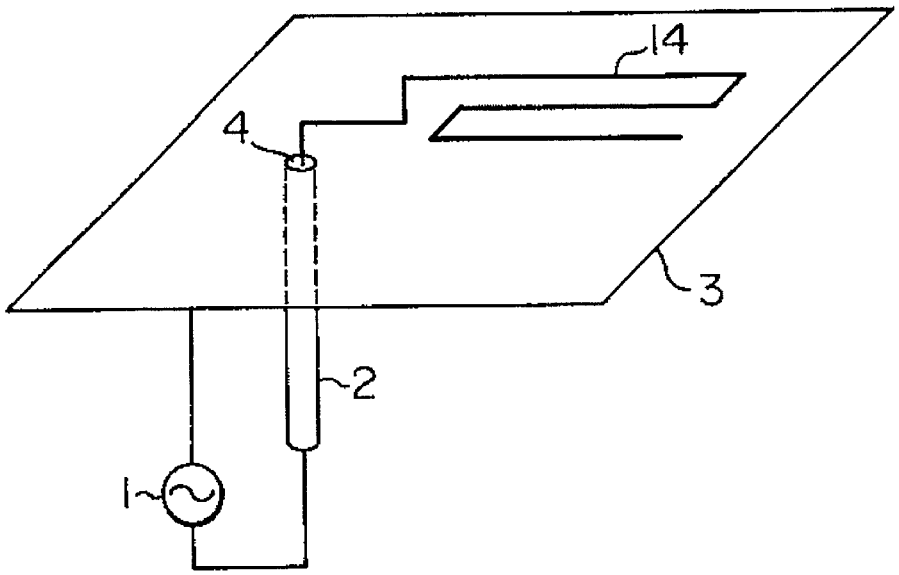
FIG. 15 is a perspective view showing an embodiment of a small antenna for a portable radio phone according to the present invention.

FIG. 15 is a perspective view showing an embodiment of a small antenna for a portable radio phone according to the present invention. What differs from FIG. 7 is the fact that, in lieu of providing the step conductor 5 and the second conductor 7 stretching in parallel to the finite ground 3 in close vicinity to a part parallel to the finite ground 3 of the step conductor in parallel thereto and without coming into contact electrically therewith, a conductor 14 including one bent line of step structure in which two similar second conductors are connected to ground, one end thereof and one end different from the exciting point 4 of the step conductor 5 being connected to each other using a conductor parallel to the finite ground 3, and reach a point that is an open part without including a branch from the exciting point 4. In the case of FIG. 7, when the length of a part parallel to the finite ground 3 corresponding to the second step when viewed from the exciting point 4 of the step structure is long, it is possible to curtail the antenna structure in the longitudinal direction by using the present embodiment. Thus, an effect of increasing the degree of freedom in arrangement in a body when the antenna is built in the body is produced.

Figure 16:
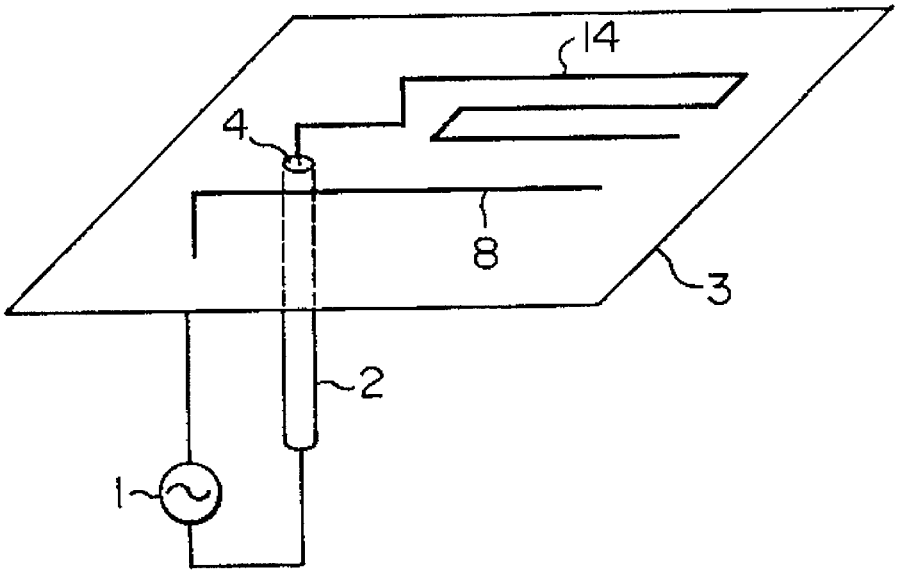
FIG. 16 is a perspective view showing an embodiment of a small antenna for a portable radio phone according to the present invention.

FIG. 16 is a perspective view showing an embodiment of a small antenna for a portable radio phone according to the present invention. What differs from FIG. 15 is the fact that there is provided, separately from the conductor 14 having the structure including a step conductor, another third conductor 8 having a configuration that one end of the second conductor stretching in parallel to the finite ground 3 in close vicinity to a part parallel to the finite ground 3 of the step conductor in parallel thereto and without coming into contact electrically therewith is connected electrically by a conductor perpendicular to the finite ground 3. There is an effect that the length where the energy moves from the exciting point 4 into the free space is diversified because of the similar principle as the description of FIG. 8, and the frequency band where the conditions of excellent impedance matching are satisfied between the radio frequency and the antenna is increased further.

Figure 17:
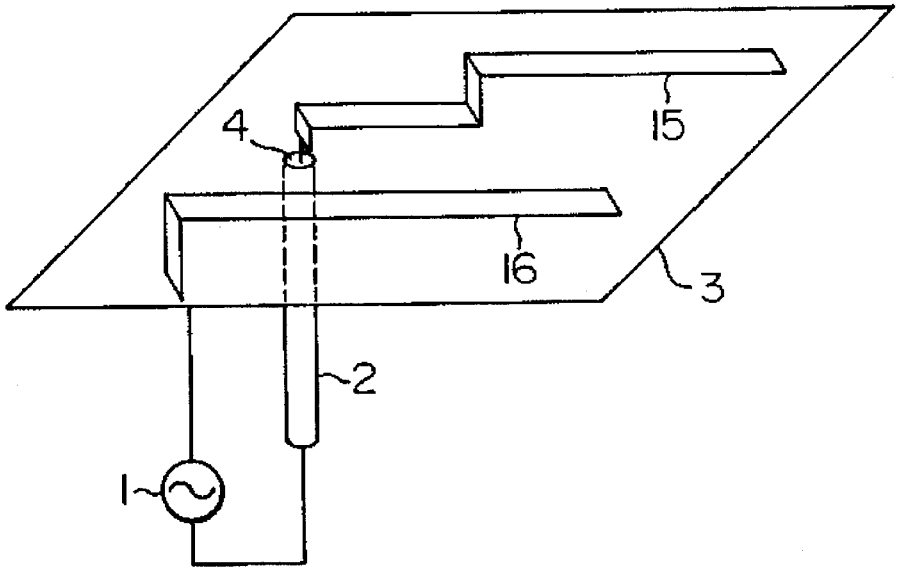
FIG. 17 is a perspective view showing an embodiment of a small antenna for a portable radio phone according to the present invention.

FIG. 17 is a perspective view showing an embodiment of a small antenna for a portable radio phone according to the present invention. What differs from FIG. 8 is the fact that step conductor 5 and the third conductor 8 each composed of a linear conductor are replaced with a step conductor 15 and a second conductor 16 composed of a strip conductor, respectively. A manufactural technology by press machine such as folding and blanking is easier for the strip conductor as compared with the linear conductor, thus producing an effect of cost reduction when the present embodiment is applied to products.

Figure 18:
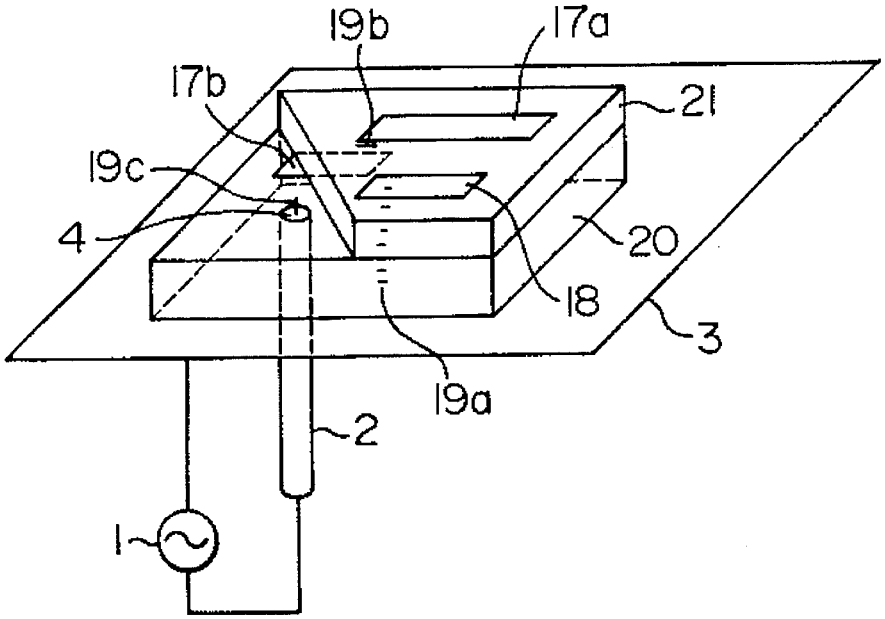
FIG. 18 is a perspective view showing an embodiment of a small antenna for a portable radio phone according to the present invention.

FIG. 18 is a perspective view showing an embodiment of a small antenna for a portable radio phone according to the present invention. What differs from FIG. 8 is the fact that, in a structure corresponding to the step conductor 5 and the third conductor 8, the part parallel to the finite ground 3 at the first step when viewed from the exciting point 4 of the step conductor is formed of a strip conductor 17*b* formed on a first dielectric plate 20, a part parallel to the finite ground 3 at the second step when viewed from the exciting point 4 of the step conductor is formed of a strip conductor 17*a* formed on a second dielectric plate 21, a part parallel to the finite ground 3 of the second conductor is formed of a strip conductor 18 formed on the second dielectric plate 21, one end of the strip conductor 17*b* and the exciting point 4 are connected with each other by a connecting pin 19*c*, another end of the strip conductor 17*b* and one end of the strip conductor 17*a* are connected with each other by a connecting pin 19*b*, and one end of the strip conductor 18 and a point on the finite ground 3 are connected with each other by a connecting pin 19*a*. Since the antenna structure can be realized using a manufactural technology of printed circuit of a thin film conductor and a thick film conductor according to the present embodiment, an effect is produced in cost reduction in mass production when the present embodiment is applied to products.

Figure 19:
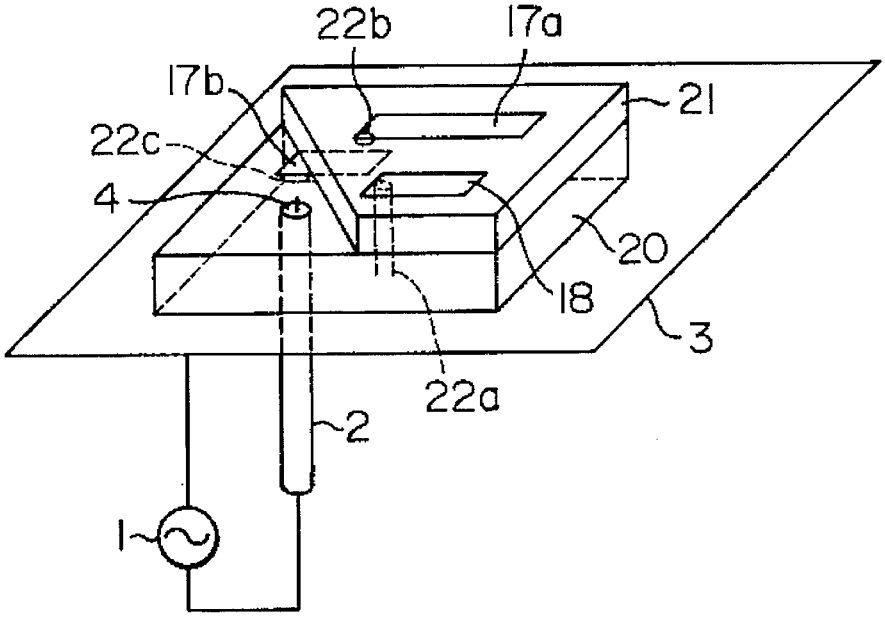
FIG. 19 is a perspective view showing an embodiment of a small antenna for a portable radio phone according to the present invention.

FIG. 19 is a perspective view showing an embodiment of a small antenna for a portable radio phone according to the present invention. What differs from FIG. 18 is the fact that connection of strip conductors 17*a*, 17*b* and 18, the exciting point 4 and the finite ground 3 is realized with through holes 22*a*, 22*b* and 22*c*. According to the present embodiment, it is possible to realize an antenna structure through a consistent manufacturing process using manufactural technology of printed circuit and manufactural technology of making through hole of a thin film conductor and a thick film conductor. Therefore, further reduction of the mass production cost when the present embodiment is applied to products is achieved.

Figure 20:
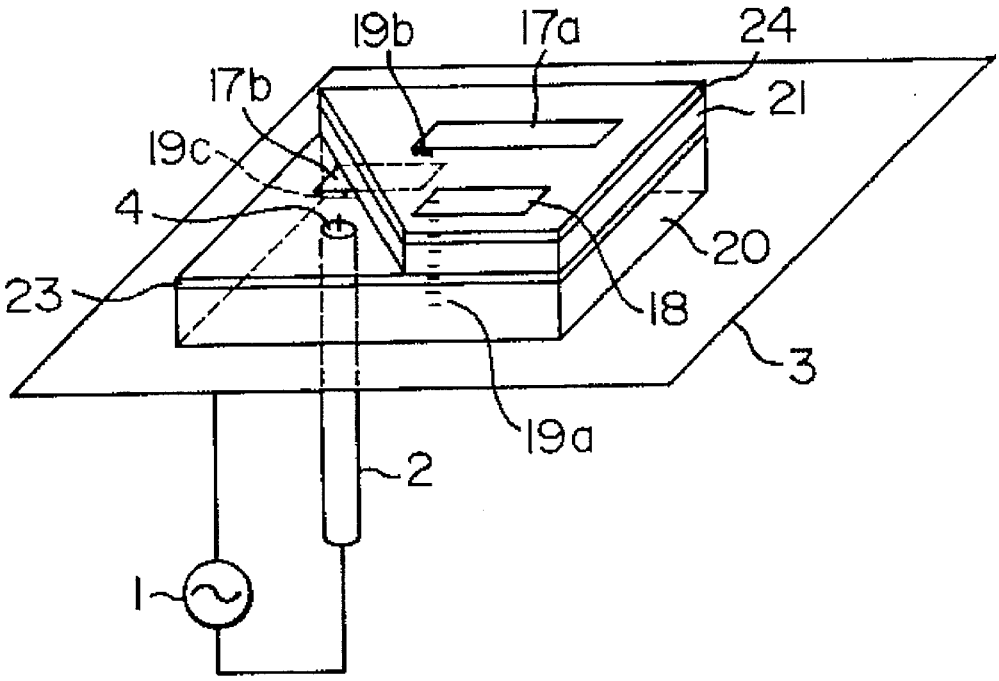
FIG. 20 is a perspective view showing an embodiment of a small antenna for a portable radio phone according to the present invention.

FIG. 20 is a perspective view showing an embodiment of a small antenna for a portable radio phone according to the present invention. What differs from FIG. 18 is the fact that the strip conductor 17*b* is realized on a first dielectric sheet 23, the dielectric sheet is stuck onto the first dielectric plate 20, strip conductors 17*b* and 18 are realized on a second dielectric sheet 24, and the dielectric sheet is realized by being stuck onto a second dielectric plate 21. Since the manufactural technology of printed circuit of a thin film conductor and a thick film conductor used for forming a strip conductor may be applied much more easily according to the present embodiment, the effect of reduction of mass production cost at time of application to products is remarkable.

Figure 21:
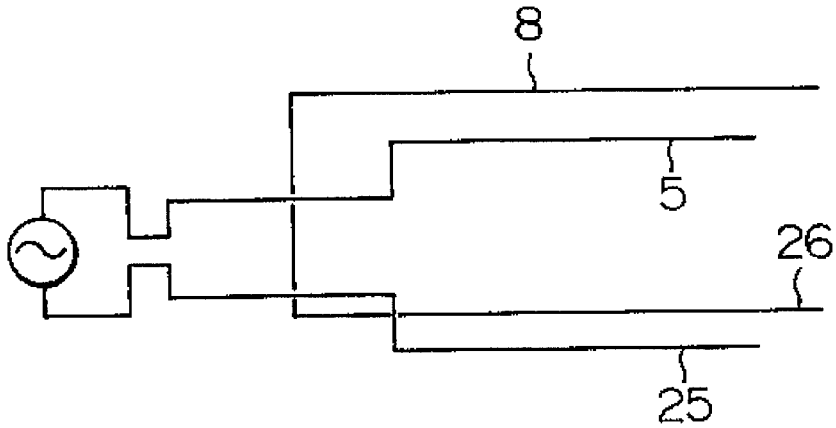
FIG. 21 is a perspective view showing an embodiment of a small antenna for a portable radio phone according to the present invention.
Figure 22:
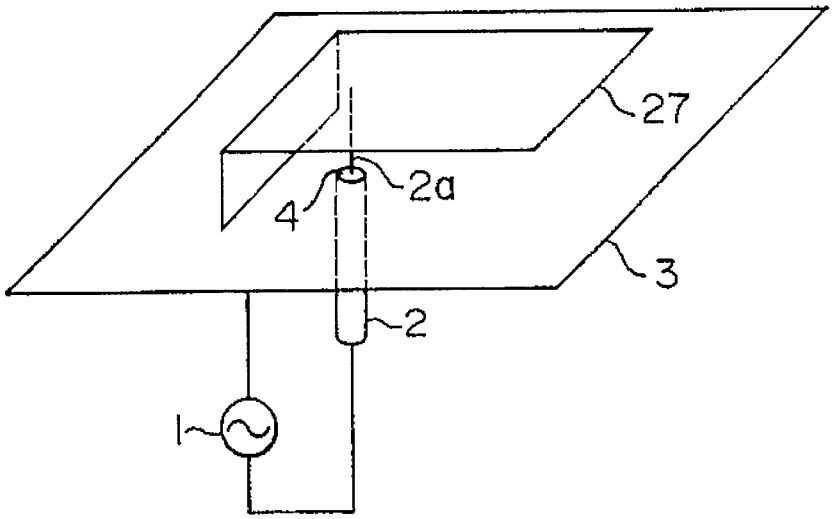
FIG. 22 (PRIOR ART)
FIG. 22 is a perspective view of a conventional inverse-F antenna.
Figure 23:
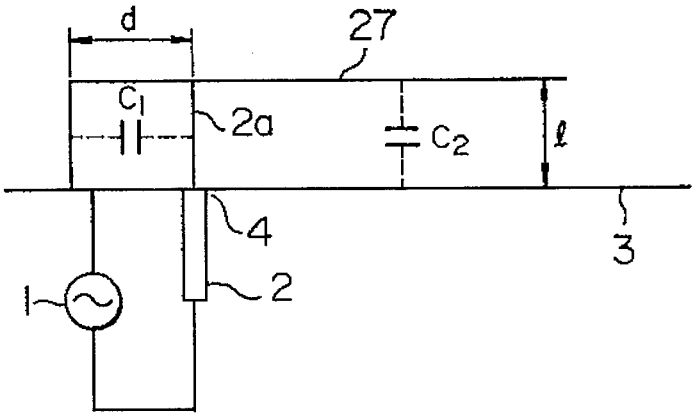
FIG. 23 (PRIOR ART)
FIG. 23 is a side view of a conventional inverse-F antenna.
Figure 24:
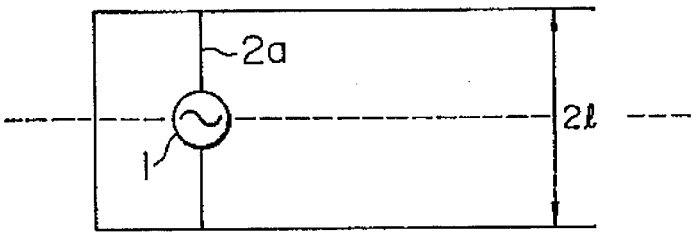
FIG. 24 is a side view of an antenna that becomes equivalent to FIG. 2 when an image theorem is applied.

FIG. 21 is a perspective view showing an embodiment of a small antenna for a portable radio phone according to the present invention. What differs from FIG. 8 is the fact that plane-symmetrical structures 25 and 26 are added newly with the finite ground 3 as a plane of symmetry to the step conductor 5 and the third conductor 8, respectively, the finite ground 3 is removed, the step conductor 5 and the symmetrical structure 25 thereof are fed in a balanced manner by an exciting source 1 at a point where the finite ground 3 was in existence, and the third conductor 8 and the symmetrical structure 26 are connected electrically with each other at a point where the finite ground 3 was in existence. Since it is possible to feed an antenna in a balanced manner according to the present invention, it is possible to apply the present structure to a radio phone in which power is fed from an RF part through balanced lines.

According to the present invention, it is possible to realize an antenna for realizing excellent matching with the impedance of the radio part without a resonant part for accumulating large reactive power. Accordingly, it becomes possible to provide a small antenna or a built-in antenna applied to a small portable radio phone.

I claim:

1. A small antenna for a portable radio phone comprising:

a finite ground forming a part of a portable radio phone and having a small hole; and a step conductor in which a conductor stretches perpendicularly to said finite ground from the central part of the small hole, then the conductor stretches in parallel to said finite ground, then the conductor stretches again perpendicularly to said finite ground, and then the conductor stretches in parallel to said finite ground without coming into direct contact electrically with said finite ground;

respective parts of said step conductor parallel to said finite ground being formed without overlapping each other when viewed from said finite ground;

electric power is supplied, with said finite ground kept at ground potential, from a surface of said finite ground where said step conductor does not exist with one point of said step conductor located at the central part of the small hole of said finite ground as an exciting point; and a height of respective parts of said step conductor parallel to said finite ground increases with respect to said finite ground as the number of steps is increased when viewed from the exciting point.

2. A small antenna for a portable radio phone according to claim 1, wherein said step conductor is a linear conductor.

3. A small antenna for a portable radio phone according to claim 1, wherein said step conductor is a strip conductor.

4. A small antenna for a portable radio phone according to claim 1, wherein two conductors perpendicular to said finite ground of said step conductor are linear conductors and two conductors parallel to said finite ground of said step conductor are strip conductors.

5. A small antenna for a portable radio phone according to claim 4, further comprising:

a first dielectric plate placed on said finite ground; and a second dielectric plate placed on said first dielectric plate; wherein:

a strip conductor parallel to said finite ground at the first step when viewed from the exciting point of said step conductor is formed in a print pattern printed on said first dielectric plate; and a strip conductor parallel to said finite ground at the second step when viewed from the exciting point of said step conductor is formed in a print pattern printed on said second dielectric plate.

6. A small antenna for a portable radio phone according to claim 5, wherein an exciting point and one end of a strip conductor parallel to said finite ground at said first step, or another end of a strip conductor parallel to said finite ground at said first step and one end of a strip conductor parallel to said finite ground at said second step are connected to each other by a first connecting pin or a second connecting pin penetrating said first dielectric plate or said second dielectric plate, respectively.

7. A small antenna for a portable radio phone according to claim 5, wherein an exciting point and one end of a strip conductor parallel to said finite ground at said first step, or another end of a strip conductor parallel to said finite ground at said first step and one end of a strip conductor parallel to said finite ground at said second step are connected to each other through a first through hole or a second through hole penetrating said first dielectric plate or said second dielectric plate, respectively.

8. A small antenna for a portable radio phone according to claim 4, further comprising:

a first dielectric plate placed on said finite ground;

a first dielectric sheet stuck onto said first dielectric plate;

a second dielectric plate placed on said first dielectric sheet; and a second dielectric sheet stuck onto said second dielectric plate; wherein:

a strip conductor parallel to said finite ground at the first step when viewed from the exciting point of said step conductor is formed in a print pattern printed on said first dielectric sheet; and a strip conductor parallel to said finite ground at the second step when viewed from the exciting point of said step conductor is formed in a print pattern printed on said second dielectric sheet.

9. A small antenna for a portable radio phone according to claim 8, wherein an exciting point and one end of a strip conductor parallel to said finite ground at said first step, or another end of a strip conductor parallel to said finite ground at said first step and one end of a strip conductor parallel to said finite ground at said second step are connected to each other by a first connecting pin or a second connecting pin penetrating said first dielectric sheet and said first dielectric plate or said second dielectric sheet and said second dielectric plate, respectively.

10. A small antenna for a portable radio phone according to claim 8, wherein an exciting point and one end of a strip conductor parallel to said finite ground at said first step, or another end of a strip conductor parallel to said finite ground at said first step and one end of a strip conductor parallel to said finite ground at said second step are connected to each other through a first through hole or a second through hole penetrating said first dielectric sheet and said first dielectric plate or said second dielectric sheet and said second dielectric plate, respectively.

11. A small antenna for a portable radio phone according to claim 1, further comprising:

a second conductor located in the vicinity of said step conductor and parallel to a conductor parallel to said finite ground at the uppermost step of said step conductor.

12. A small antenna for a portable radio phone according to claim 11, wherein said second conductor and the conductor parallel to said finite ground at the uppermost step of said step conductor have the same height with respect to said finite ground.

13. A small antenna for a portable radio phone according to claim 12, wherein said second conductor makes no contact electrically with said finite ground and said step conductor.

14. A small antenna for a portable radio phone according to claim 13, wherein said step conductor and said second conductor are linear conductors.

15. A small antenna for a portable radio phone according to claim 13, wherein said step conductor and said second conductor are strip conductors.

16. A small antenna for a portable radio phone according to claim 13, wherein a plurality of said second conductors are installed.

17. A small antenna for a portable radio phone according to claim 1, further comprising:

a third conductor located in the vicinity of said step conductor, parallel to a conductor parallel to said finite ground at the uppermost step of said step conductor, and connected electrically to said finite ground.

18. A small antenna for a portable radio phone according to claim 17, wherein said third conductor and the conductor parallel to said finite ground at the uppermost step of said step conductor have the same height with respect to said finite ground.

19. A small antenna for a portable radio phone according to claim 17, wherein two conductors perpendicular to said finite ground of said step conductor are linear conductors, and two conductors parallel to said finite ground of said step conductor and said third conductor are strip conductors.

20. A small antenna for a portable radio phone according to claim 19, wherein said third conductor makes no contact electrically with said step conductor.

21. A small antenna for a portable radio phone according to claim 20, wherein said step conductor and said third conductor are linear conductors.

22. A small antenna for a portable radio phone according to claim 20, wherein said step conductor and said third conductor are strip conductors.

23. A small antenna for a portable radio phone according to claim 20, wherein a plurality of said third conductors are installed.

24. A small antenna for a portable radio phone according to claim 19, further comprising:

a first dielectric plate placed on said finite ground; and a second dielectric plate placed on said first dielectric plate; wherein:

a strip conductor parallel to said finite ground at the first step when viewed from the exciting point of said step conductor is formed in a print pattern printed on said first dielectric plate; and a strip conductor parallel to said finite ground at the second step when viewed from the exciting point of said step conductor and said third conductor are formed in a print pattern printed on said second dielectric plate.

25. A small antenna for a portable radio phone according to claim 24, wherein:

an exciting point and one end of a strip conductor parallel to said finite ground at said first step, or another end of a strip conductor parallel to said finite ground at said first step and one end of a strip conductor parallel to said finite ground at said second step are connected to each other by a first connecting pin or a second connecting pin penetrating said first dielectric plate or said second dielectric plate, respectively; and said finite ground and one end of said third conductor are connected to each other by a third connecting pin penetrating said first dielectric plate and said second dielectric plate.

26. A small antenna for a portable radio phone according to claim 25, wherein:

an exciting point and one end of a strip conductor parallel to said finite ground at said first step, or another end of a strip conductor parallel to said finite ground at said first step and one end of a strip conductor parallel to said finite ground at the second step are connected to each other through a first through hole or a second through hole penetrating said first dielectric plate or said second dielectric plate, respectively; and said finite ground and one end of said third conductor are connected to each other through a third through hole penetrating said first dielectric plate and said second dielectric plate.

27. A small antenna for a portable radio phone according to claim 1, wherein there is provided a conductor that is perpendicular to said step conductor and makes no contact electrically with said finite ground at one end that is not the exciting point of said step conductor.

28. A small antenna for a portable radio phone according to claim 27, wherein said step conductor is a linear conductor.

29. A small antenna for a portable radio phone according to claim 27, wherein said step conductor is a strip conductor.

30. A small antenna for a portable radio phone according to claim 27, further comprising:

a third conductor located in the vicinity of said step conductor, parallel to a conductor parallel to said finite ground at the uppermost step of said step conductor, and connected electrically to said finite ground.

31. A small antenna for a portable radio phone according to claim 30, wherein there is provided a conductor that is perpendicular to said third conductor and makes no contact electrically with said finite ground at one end that is not connected to said finite ground of said third conductor.

32. A small antenna for a portable radio phone according to claim 31, wherein said step conductor and said third conductor are linear conductors.

33. A small antenna for a portable radio phone according to claim 31, wherein said step conductor and said third conductor are strip conductors.

34. A small antenna for a portable radio phone according to claim 1, wherein an angle θ formed by two conductors parallel to said finite ground is approximately 180° when viewed from the side of said finite ground.

35. A small antenna for a portable radio phone according to claim 34, further comprising:

a third conductor located in the vicinity of said step conductor, parallel to a conductor parallel to said finite ground at the uppermost step of said step conductor, and connected electrically to said finite ground.

36. A small antenna for a portable radio phone according to claim 35, wherein said step conductor and said third conductor are linear conductors.

37. A small antenna for a portable radio phone according to claim 36, wherein said step conductor and said third conductor are strip conductors.

38. A small antenna for a portable radio phone according to claim 1, wherein conductors parallel to said finite ground at the uppermost step of said step conductor are bent optionally in a plane parallel to said finite ground without coming into contact mutually.

39. A small antenna for a portable radio phone according to claim 38, further comprising:

a third conductor located in the vicinity of said step conductor, parallel to a conductor parallel to said finite ground at the uppermost step of said step conductor, and connected electrically to said finite ground.

40. A small antenna for a portable radio phone according to claim 39, wherein said step conductor and said third conductor are linear conductors.

41. A small antenna for a portable radio phone according to claim 39, wherein said step conductor and said third conductor are strip conductors.

42. A small antenna for a portable radio phone, comprising:

a finite ground forming a part of a portable radio phone and having a small hole; and a step conductor having a number of steps n, wherein $n \geqq 2$, without coming into direct contact electrically with said finite ground;

wherein electric power is supplied from a surface of said finite ground where said step conductor does not exist with said finite ground kept at a ground potential with one end of said step conductor located at a central part of the small hole of said finite ground as an exciting point;

respective parts of said step conductor parallel to said finite ground being formed without overlapping each other when viewed from said finite ground;

a height of respective parts of said step conductor parallel to said finite ground increases with respect to said finite ground as the number of steps is increased when viewed from the exciting point; and a part of said step conductor parallel to said finite ground at an lth step when viewed from the exciting point has an impedance which is larger than an impedance of the exciting point and is smaller than an impedance of a part of said step conductor parallel to said finite ground at an mth step, wherein $l<m<n$, when viewed from the exciting step.

43. A small antenna for a portable radio phone according to claim 42, further comprising:

a third conductor located in the vicinity of said step conductor, parallel to a part parallel to said finite ground of said step conductor at the nth step when viewed from an exciting point, and connected electrically with said finite ground.

44. A small antenna for a portable radio phone according to claim 43, wherein said third conductor and the part parallel to said finite ground of said step conductor at the nth step when viewed from an exciting point have the same height with respect to said finite ground.

45. A small antenna for a portable radio phone according to claim 44, wherein said third conductor makes no contact electrically with said step conductor.

46. A small antenna for a portable radio phone according to claim 42, further comprising:

a second conductor located in the vicinity of said step conductor and parallel to a part parallel to said finite ground of said step conductor at the nth step when viewed from the exciting point.

47. A small antenna for a portable radio phone according to claim 46, wherein said second conductor and a part parallel to said finite ground of said step conductor at the nth step when viewed from the exciting point have the same height with respect to said finite ground.

48. A small antenna for a portable radio phone according to claim 47, wherein said second conductor makes no contact electrically with said finite ground and said step conductor.

* * * * *